US009414737B2

(12) United States Patent
Paschini et al.

(10) Patent No.: US 9,414,737 B2
(45) Date of Patent: Aug. 16, 2016

(54) CUTLERY TRAY, DISHWASHER BASKET AND DISHWASHER

(75) Inventors: Claudio Paschini, Roveredo in Piano (IT); Peter Bacher, Forchheim (DE)

(73) Assignee: Electrolux Homke Products Corporation N.V., Brussels (BE)

( * ) Notice: Subject to any disclaimer, the term of this patent is extended or adjusted under 35 U.S.C. 154(b) by 217 days.

(21) Appl. No.: 13/583,762

(22) PCT Filed: Mar. 11, 2011

(86) PCT No.: PCT/EP2011/001202

§ 371 (c)(1),
(2), (4) Date: Sep. 10, 2012

(87) PCT Pub. No.: WO2011/110361

PCT Pub. Date: Sep. 15, 2011

(65) Prior Publication Data

US 2013/0002107 A1 Jan. 3, 2013

(30) Foreign Application Priority Data

Mar. 12, 2010 (EP) ..... 10002618

(51) Int. Cl.

| | |
|---|---|
| ***A47B 77/08*** | (2006.01) |
| ***A47B 81/00*** | (2006.01) |
| ***A47L 15/50*** | (2006.01) |

(52) U.S. Cl.

CPC ..... *A47L 15/502* (2013.01); *A47L 15/505* (2013.01)

(58) Field of Classification Search

CPC ..... A47L 15/502; A47L 15/505

USPC ..... 312/228.1; 211/70.7; 134/135

See application file for complete search history.

(56) References Cited

U.S. PATENT DOCUMENTS

| | | | | |
|---|---|---|---|---|
| 1,691,858 | A | 11/1928 | Ryerson | |
| 1,714,266 | A | 5/1929 | Ernest | |
| 2,600,096 | A | 6/1952 | Cooper et al. | |
| 3,887,102 | A | 6/1975 | Earley | |
| 3,935,958 | A | 2/1976 | Frangos | |
| 4,046,261 | A | 9/1977 | Yake | |
| 4,372,448 | A * | 2/1983 | Drach | 211/41.3 |
| 4,564,118 | A | 1/1986 | Heyer et al. | |
| 5,016,772 | A | 5/1991 | Wilk | |

(Continued)

FOREIGN PATENT DOCUMENTS

| | | | |
|---|---|---|---|
| CN | 101563016 | A | 10/2009 |
| DE | 1 917 909 | U | 6/1965 |

(Continued)

OTHER PUBLICATIONS

International Search Report for Application No. PCT/EP2011/001202, dated Jan. 25, 2012.

(Continued)

*Primary Examiner* — Daniel J Troy
*Assistant Examiner* — Timothy M Ayres
(74) *Attorney, Agent, or Firm* — Alston & Bird LLP

(57) ABSTRACT

The invention in particular is related to a cutlery tray (1) adapted to be attached to a dishwasher basket (2) and designed to receive dishes thereon. In order to ensure high cleaning efficiency and loading flexibility the bottom (3) of the cutlery tray (1) is divided into two support faces (7) each of which declining laterally from their joining portion (8) to a respective margin (5) of the cutlery tray (1).

17 Claims, 4 Drawing Sheets

(56) References Cited

U.S. PATENT DOCUMENTS

| | | | | |
|---|---|---|---|---|
| 5,083,827 | A | 1/1992 | Hollenbaugh, Sr. | |
| 5,086,544 | A | 2/1992 | Huttemann | |
| 5,431,294 | A | 7/1995 | Stottmann et al. | |
| 5,462,348 | A | 10/1995 | Ellingson et al. | |
| 5,626,242 | A | 5/1997 | Weizer | |
| 5,881,906 | A | 3/1999 | Rogers et al. | |
| 6,125,548 | A | 10/2000 | Dunn et al. | |
| 6,467,622 | B1 | 10/2002 | Hull | |
| 6,945,421 | B2 | 9/2005 | Phifer | |
| 7,231,929 | B2 | 6/2007 | Landsiedel et al. | |
| 7,445,128 | B2 | 11/2008 | Kaczmarek | |
| 7,455,066 | B2 | 11/2008 | Feddema et al. | |
| 7,458,473 | B1 | 12/2008 | Mason | |
| 7,464,827 | B2 | 12/2008 | Meissen | |
| 7,478,642 | B2 | 1/2009 | Koch et al. | |
| 7,862,664 | B2 | 1/2011 | Choi et al. | |
| 7,931,155 | B2 | 4/2011 | Bastuji | |
| 8,163,103 | B2 | 4/2012 | Shin et al. | |
| 8,191,560 | B2 | 6/2012 | Mallory et al. | |
| 8,196,593 | B2 | 6/2012 | Schessl et al. | |
| 8,303,725 | B2 | 11/2012 | Crookshanks et al. | |
| 8,353,412 | B2 | 1/2013 | Rosenbauer et al. | |
| 8,522,998 | B2 | 9/2013 | Crookshanks et al. | |
| 8,540,085 | B2 | 9/2013 | Klump et al. | |
| 8,651,287 | B2 | 2/2014 | Moser et al. | |
| 8,746,467 | B2 | 6/2014 | Jeong | |
| 8,858,725 | B2 | 10/2014 | Mailander | |
| 9,119,524 | B2 | 9/2015 | Renz et al. | |
| 2003/0089672 | A1 | 5/2003 | VanLandingham | |
| 2004/0079713 | A1 | 4/2004 | Wendt et al. | |
| 2005/0167374 | A1* | 8/2005 | Yang et al. | 211/41.18 |
| 2005/0178412 | A1* | 8/2005 | Koch et al. | 134/135 |
| 2005/0241682 | A1 | 11/2005 | Jeong et al. | |
| 2006/0113260 | A1 | 6/2006 | Purushothaman et al. | |
| 2006/0219271 | A1 | 10/2006 | Feddema et al. | |
| 2006/0243681 | A1 | 11/2006 | Bastuji et al. | |
| 2006/0250058 | A1 | 11/2006 | Stevens et al. | |
| 2007/0039636 | A1* | 2/2007 | Egger et al. | 134/56 D |
| 2007/0039904 | A1 | 2/2007 | Purushothaman | |
| 2007/0090063 | A1 | 4/2007 | Schmidt | |
| 2007/0119801 | A1 | 5/2007 | Miele et al. | |
| 2008/0072937 | A1 | 3/2008 | Choi et al. | |
| 2008/0110480 | A1 | 5/2008 | Choi et al. | |
| 2008/0156358 | A1 | 7/2008 | Shin et al. | |
| 2008/0156362 | A1 | 7/2008 | Shin et al. | |
| 2008/0169009 | A1 | 7/2008 | Mailander | |
| 2008/0302740 | A1 | 12/2008 | Moser et al. | |
| 2009/0038657 | A1 | 2/2009 | Kang | |
| 2009/0140619 | A1 | 6/2009 | Buehlmeyer et al. | |
| 2010/0051069 | A1 | 3/2010 | Schessl et al. | |
| 2010/0117498 | A1 | 5/2010 | Leinmuller et al. | |
| 2010/0155280 | A1 | 6/2010 | Graute | |
| 2010/0314977 | A1 | 12/2010 | Mallory et al. | |
| 2011/0193457 | A1 | 8/2011 | Bastuji | |
| 2011/0247990 | A1 | 10/2011 | Chai | |
| 2011/0253650 | A1 | 10/2011 | Renz et al. | |
| 2012/0139400 | A1* | 6/2012 | Hofpeter et al. | 312/228.1 |
| 2012/0181242 | A1 | 7/2012 | Jeong | |
| 2012/0292269 | A1 | 11/2012 | Klump et al. | |
| 2014/0190528 | A1 | 7/2014 | Wegener et al. | |
| 2015/0182104 | A1 | 7/2015 | Jeong et al. | |
| 2015/0196189 | A1 | 7/2015 | Shaffer et al. | |
| 2015/0245761 | A1 | 9/2015 | Zhou et al. | |
| 2015/0335225 | A1 | 11/2015 | Seu | |

FOREIGN PATENT DOCUMENTS

| | | | |
|---|---|---|---|
| DE | 7008981 | U | 7/1970 |
| DE | 7032937 | U | 12/1970 |
| DE | 2 701 879 | A1 | 7/1978 |
| DE | 3 534 897 | A1 | 4/1987 |
| DE | 43 09 915 | | 9/1994 |
| DE | 195 40 611 | A1 | 5/1997 |
| DE | 199 28 040 | A1 | 12/1999 |
| DE | 299 01 901 | U1 | 6/2000 |
| DE | 10 353 725 | A1 | 6/2005 |
| DE | 10 2008 062 761 | B3 | 3/2010 |
| DE | 10 2010 042 409 | A1 | 4/2012 |
| DE | 10 2011 081 774 | A1 | 2/2013 |
| EP | 0 186 157 | A1 | 7/1986 |
| EP | 1 072 221 | | 1/2001 |
| EP | 2 272 416 | A2 | 1/2011 |
| EP | 2 377 455 | A1 | 10/2011 |
| EP | 2 478 820 | A2 | 7/2012 |
| EP | 2 554 097 | A2 | 2/2013 |
| EP | 2865316 | A1 | 4/2015 |
| ES | 2 168 937 | A1 | 6/2002 |
| GB | 2 042 147 | A | 9/1980 |
| GB | 2419083 | A | 4/2006 |
| JP | 59 174154 | U | 11/1984 |
| JP | S62-61673 | U | 4/1987 |
| JP | 63 095573 | U | 6/1988 |
| JP | 64 028259 | U | 2/1989 |
| JP | 10-328117 | A | 12/1998 |
| JP | 2002345578 | A | 12/2003 |
| WO | WO-03/055375 | | 7/2003 |
| WO | WO 03/055376 | A1 | 7/2003 |
| WO | WO 2004/000090 | A1 | 12/2003 |
| WO | WO-2005/037051 | | 4/2005 |
| WO | WO-2005/041744 | | 5/2005 |
| WO | WO-2006/056515 | | 6/2006 |
| WO | WO 2008/035866 | A1 | 3/2008 |
| WO | WO-2008/061869 | | 5/2008 |

OTHER PUBLICATIONS

European Search Report for Application No. EP 09 01 1294 dated Feb. 3, 2010.

Office Action for European Application No. EP 09 011 294.7 dated Feb. 1, 2013.

European Search Report for Application No. EP 10 00 2618 dated Jul. 19, 2010.

International Search Report and Written Opinion for International Application No. PCT/EP2010/005252, mailed Dec. 14, 2010.

Letter received from Louis Pohlau Lohrentz regarding Opposition against EP 2 364 636 B1 of Electrolux Home Products Corporation; VII. Indication of Facts and Evidence as to Grounds on Which the Opposition is Based Pursuant to Rule 75(2)(c) EPC, dated Mar. 19, 2014, 14 pages.

Notice of Opposition to a European Patent (EP 2364636) dated Mar. 29, 2014, 5 pages.

Written Opinion for Application No. PCT/EP2011/001202, dated Jan. 25, 2012.

International Search Report for PCT/EP2012/076755; dated Feb. 27, 2013.

Written Opinion for Application No. PCT/EP2012/076755, dated Feb. 27, 2013.

International Search Report for PCT/EP2012/076761; dated Sep. 3, 2013.

Written Opinion for Application No. PCT/EP2012/076761, dated Sep. 3, 2013.

Statement Regarding the Opposition of European Patent No. 2364636 w/Appendix dated May 12, 2016 for U.S. Appl. No. 13/583,762.

Office Action for U.S. Appl. No. 14/653,178 dated Mar. 2, 2016.

Letter from Louis Pohlau Lohrentz regarding Opposition Against EP 2 364 636 B1 of Electrolux Home Products Corp. N.V. in response to Patentees Letter of Aug. 26, 2013 introducing documents (dated Mar. 23, 2016.

* cited by examiner

CUTLERY TRAY, DISHWASHER BASKET AND DISHWASHER

CROSS REFERENCE TO RELATED APPLICATIONS

This application is a national stage application filed under 35 U.S.C. 371 of International Application No. PCT/EP2011/001202, filed Mar. 11, 2011, which claims priority from European Patent Application No. 10002618.6, filed Mar. 12, 2010, each of which is incorporated herein in its entirety.

The invention in particular is directed to a cutlery tray adapted to be attached to a dishwasher basket of a dishwasher.

Such cutlery trays in general are provided as additional magazines for space saving and proper placement of cutlery, for example, within a dishwasher having one or several dishwasher baskets.

DE 43 09 915 C2 exemplarily shows such a cutlery tray comprising a box shaped tray and legs projecting from the lower bottom side of the tray. The legs are adapted to moveably attach the cutlery tray on opposing upper side wall wires of a dishwasher basket. Each of the lower bottom sides of the legs has an slot adapted to receive a side wall wire. The side wall wires serve as rails along which the cutlery tray can be moved via the slots. In U.S. Pat. No. 5,462,348 a wheel-rail-system is used for moveably attaching a cutlery tray to a dishwasher basket. The wheels provided with the cutlery tray engage with side wall wires of the dishwasher basket.

EP 1 072 221 A1 shows a cutlery tray moveably provided with a dishwasher basket. Here, a special wire structure is provided on which the cutlery tray can be pushed forth and back like a push loading drawer. Movement of the cutlery tray is enabled from a front face of the dishwasher basket. The special wire structure may adversely affect accessibility to the dishwasher basket.

Cutlery trays are further known from WO 2003/055375 A1, WO 2006/056515 A1 and WO 2008/061869 A1. The known cutlery trays are designed as separate units not attachable to a dishwasher basket and operable independently from dishwasher baskets. The cutlery trays are specially adapted to receive cutlery and other dishes such as cups. Providing cutlery trays as separate units has the disadvantage of limiting the remaining space for placing dishwasher baskets within the dishwasher chamber. Here, flexibility with respect to placing dishes into the dishwasher basket underneath may be adversely affected.

It is an object of the invention to provide a cutlery tray allowing high flexibility with respect to loading dishes to a dishwasher. Further the cutlery tray shall provide good cleaning and drying efficiency for dishes, in particular cutlery, and other utensils placed thereon. Alike, a dishwasher basket and a dishwasher shall be provided.

This object is achieved by the features listed in claims 1, 15 and 16, respectively. Embodiments of the invention result from dependent claims 2 to 14.

A first aspect of the invention is directed to a cutlery tray. The cutlery tray is adapted to be attached to a dishwasher basket of a conventional dishwasher of household or industrial appliance, respectively. The cutlery tray is designed to receive dishes, in particular cutlery and other utensils, such as drinking vessels.

The bottom of the cutlery tray is divided into two support faces. Each support face declines laterally from their joining portion to a respective margin of the cutlery tray.

The cutlery tray according to the invention can be added, i.e. attached, to a dishwasher basket according to respective actual needs or dishwasher loading conditions. Therefore, the cutlery tray allows for high flexibility in loading the dishwasher.

The support faces are for placing dishes thereon. The support faces are inclined towards the outside which means that the upper sides of the support faces enclose an angle of more than 180 degrees, or in other words, the lower sides enclose an angle less than 180 degrees. The support faces slanted this way allow dishes placed thereon to be oriented towards the center of the dishwasher chamber, which in turn enhances cleaning efficiency. If for example a drinking vessel such as a cup or drinking glass is placed on a support face in upside-down orientation, the opening of the vessel can be oriented towards the center of the dishwasher chamber. Hence, the inner walls of the vessel are well accessible to cleaning liquid and therefore can be cleaned efficiently. Here it has to be mentioned that usually spray arms are used for charging dishes arranged in a dishwasher chamber with cleaning liquid. The spray arms eject spray jets which, in general, have preferential orientations ranging from vertical direction to directions slightly slanted towards one of the ends of the spray arm, in particular in addition also directed in or against the rotation direction of the spray arm. Therefore, inner surfaces of drinking vessels placed on any of the support faces in an upside-down orientation, as mentioned beforehand, are readily accessible by the spray jets. Hence, the inner surfaces can be cleaned efficiently. The same applies to other kinds of dishes.

A comparatively high cleaning efficiency can be obtained if the support faces are inclined by 20 to 30 degrees. A further advantage of such an inclination is that also drying performance can be improved. This is due to the fact that the drinking vessels are tilted in such a way that water or cleaning liquid can effectively drain off from the drinking vessels, such as cups or pots, in particular from concave bottom surfaces thereof.

An additional advantageous effect of the support faces inclined as previously described is that drinking vessels can be arranged in a space saving way in two parallel rows with respect to the lateral direction.

The joining portion of the support faces is meant to be a section of the cutlery tray from which the support faces extend towards the outside, i.e. to the margins of the cutlery tray. The joining portion can be positioned in a mid section of the cutlery tray. In the latter case, the support faces can be designed to be symmetric with respect to the joining portion. Here, equal cleaning properties can be achieved no matter on which support face the dish is placed.

The support faces can, at least partially, have a grid like structure, such as a meshwork for example. Grid bars of the grid like structure, the width-to-height or aspect ratios for example, preferably are selected to provide both sufficient stiffness and high cleaning efficiency.

The grid like structure can comprise at least one of unidirectional grid bars in parallel arrangement or grid bars in cross-wise arrangement. The support faces may differ in their grid structures and the grid structure within a single support face may vary. With respect to good cleaning efficiency, the grid structures can be specially adapted to certain kinds of dishes. For example, a first grid zone may be adapted to cutlery, while another grid zone may be additionally adapted to drinking vessels, such as cups or drinking glasses.

Mechanical stability and rigidity of the cutlery tray can be enhanced if the joining portion is designed as a broadened bar or shoulder. The joining portion may be designed to have a grid-like structure sufficiently robust to achieve adequate mechanical stability.

The joining portion may be oriented in lengthwise direction of the cutlery tray. However, it is also possible that the joining portion is oriented parallel to the width of the cutlery tray.

In order to provide sufficient support for dishes in lateral direction to the joining portion, especially when a lateral acceleration is applied, the cutlery tray may comprise flanges at the margins, i.e. side walls or side wall grids. In this case, the support faces decline to the lower edges of the flanges. The flanges may project at least up to the level of the joining portion. At least with this embodiment, a lateral cross-section of the cutlery tray, i.e. flanges, support faces and joining portion, creates a kind of W-like cross-shape.

Note that the flanges may substantially contribute to the mechanical stability and robustness of the cutlery tray.

The flanges may comprise recesses oriented away from the support faces. Such recesses may be provided in order to additionally support drinking vessels, such as cups, drinking glasses or similarly shaped objects at circumferential sections thereof. Hence, a tilting over of the vessels or similarly shaped objects placed on the cutlery tray can be prevented. Further, a movement of objects such as drinking vessels along the flanges can be prevented even if acceleration is applied thereto. Such accelerations may for example result from moving a dishwasher basket carrying the cutlery tray in or out the dishwasher chamber.

The recesses can be specially adapted to outer dimensions of drinking vessels and may therefore be of circular, oval or other shape.

In order to fix the cutlery tray on a dishwasher basket, frontal and rear face sides of the cutlery tray may comprise a frontal attachment slot and a rear attachment slot, respectively. Dishwasher basket side walls or wires can be fit into the attachment slots thereby attaching the cutlery tray to the dishwasher basket.

The frontal and/or rear attachment slot, preferably both, may open to the lower side of the cutlery tray allowing the cutlery tray to be put on and off the dishwasher basket in a vertical movement action. Especially in the case of dishwasher basket wires at least one of the attachment slots may alternatively open at the respective face side of the cutlery tray. In this case the cutlery tray may be attached to the dishwasher basket in a pivoting movement after the face side attachment slot is engaged with one of the dishwasher basket wires.

The attachment slots and the upper edges of the side walls or the dishwasher basket wires may make up a guideway system. Here, the upper edges or wires of the dishwasher basket can be used as rails along which the cutlery tray can be moved via the attachment slots engaging the rails. In this case the cutlery tray is slidable relative to the dishwasher basket. In this way the flexibility in loading the dishwasher basket can be enhanced.

The guideway system can also comprise a wheel-rail-system in which at least one of the attachment slots comprises or is represented by a wheel. The wheel may be adapted to engage the wire or upper edge.

If the width of the cutlery tray in sliding direction is smaller, preferably substantially smaller, such as ⅓ or ¼ of the dishwasher basket's width, for example, it can be moved from one side of the dishwasher basket to the opposing one in order to improve loadability of the dishwasher basket lying underneath. Further, in this case it is possible to place the cutlery tray in working position where at least the dishwasher basket carrying the cutlery tray is not loaded heavily with dishes. In such an arrangement cleaning liquid easily can pass through to the dishes arranged on the cutlery tray.

In order to prevent cutlery or similarly shaped utensils from sliding down the slanted support faces in a direction towards the margins of the cutlery tray, the support face may comprise mutually spaced bolt-like projections, such as spikes or the like. By providing projections, it can be prevented that vibrations or other impacts cause the items, such as long knifes or the like, to move to or accumulate in the lower level portion of the support faces near the flanges. Here it is advantageous if the projections extend at least up to or even beyond the level of the joining portion. Via the projections the items placed on the support faces keep being distributed over an as large area of the cutlery tray as possible, clearly enhancing cleaning efficiency. In order to minimize the contact surface between the projections and dishes lying against the projections, the sides of the projections facing towards the joining portion may have a reduced width. This can for example be achieved by star-shaped, prism-like projections or other similar geometries.

The projections are preferably oriented vertically with respect to the ordinary operation orientation of the cutlery tray. Projections thus oriented will probably not hamper an operator in loading the cutlery tray with cutlery and the like. The cross section of the projections may be circular, cross shaped or of any other type.

The projections can be arranged in several groups and the projections of each group can be distributed along a common line running parallel to the joining portion. Lines along which projections of different groups are arranged are preferably spaced apart in a direction perpendicular to the joining portion. Advantageously at least one of the lines and the projections belonging to the same group are mutually spaced at preset distances.

In order to prevent interference between said projections and the above-mentioned recesses in the flanges of the cutlery tray it is of advantage if the recesses and projections provided with a single support face alternate and are mutually offset in a direction parallel to the joining portion. Further, recesses and projections of the different support faces may be arranged in a mutually alternating way.

At least one of the attachment slots can be arranged on an attachment arm extending from one of the face sides of the cutlery tray. Preferably, the frontal attachment slot is arranged on a frontal attachment arm that extends from the frontal face side of the cutlery tray. The attachment arm can extend upwards or downwards with respect to the joining portion. In this way the geometry of the dishwasher basket, in particular differences in the levels of the upper edges of the side walls or wires, can be accounted for.

Preferably, the cutlery tray is, in a cross section, W-shaped, wherein in an advantageous embodiment, the W-shape is formed by the arrangement of the side walls with respect to the support faces.

In a preferred embodiment the frontal attachment slot is provided with the frontal attachment arm while a rear attachment arm is provided immediately at the rear face side of the cutlery tray.

Still preferably, the frontal attachment slot may be arranged at the frontal attachment arm that extends upwardly, wherein the respective upper end of the dishwasher basket's frontal side wall or side wire that engages the frontal attachment slot may be elevated with advantage. By this, additional space can be provided below the frontal attachment arm of the cutlery tray and below the frontal side wall or side wire that provides easy access to a handle or grasping slot provided at the frontal side wall of the dishwasher basket.

Easy attachment of the cutlery tray to the dishwasher basket can be achieved if the depth of one of the attachment slots is less than the other one. In this case both satisfactory attachment and guidance can be achieved. Preferably, the depth of the attachment slot provided at the attachment arm, preferably the depth of the frontal attachment slot, is less than the depth of the other attachment slot.

However, at least one of the attachment slots can comprise an undercut, preferably adequately small, in order to secure the cutlery tray to a dishwasher basket. Here, at least unintentional removal of the cutlery tray from the dishwasher basket can be prevented while still allowing the cutlery tray to be easily detached from and moved along the dishwasher basket, respectively.

As already mentioned above, in order to ease loading of the dishwasher basket and to provide high loading flexibility, the width of the cutlery tray can be less than the width of the dishwasher basket. Here, the term "width" shall denote the dimensions of the cutlery tray in a direction parallel to the face sides. Preferably the width is directed parallel to the direction of movement of the cutlery tray relative to the dishwasher basket. If the face sides of the cutlery tray are arranged at longitudinal side faces, the width may refer to the lateral width of the cutlery tray with respect to the joining portion.

The cutlery tray may be easily attached to a dishwasher basket, if the length of the cutlery tray in longitudinal direction spans at least the front to rear dimension, i.e. respective length, of the dishwasher basket. Easy attachment can be achieved by releasably mounting the cutlery tray to both a front wall and back wall of the dishwasher basket, preferably to respective upper edges of the front wall and back wall.

A second aspect of the invention is directed to a dishwasher basket for use with conventional dishwashers for household and industrial appliance. The dishwasher basket comprises at least one cutlery tray according to the first aspect of the invention and arranged on an upper rim thereof. The upper rim can be a wire or an upper edge of a side wall of the dishwasher basket.

With respect to further advantages and advantageous effects of the dishwasher basket according to the second aspect of the invention reference is made to the first aspect of the invention.

A third aspect of the invention is directed to a dishwasher of household or industrial appliance, respectively. The dishwasher comprises at least one of a cutlery tray according to the first aspect of the invention and a dishwasher basket, preferably an upper one according to the second aspect of the invention. With respect to advantages and advantageous effects of the dishwasher according to the third aspect of the invention reference is made to the first and second aspect of the invention.

Note that the cutlery tray according to the invention does not represent a separate push loading drawer-like rack for placing dishes thereon. Rather, the cutlery tray shall be attachable, preferable in a moveable way, to a dishwasher basket, preferably to an upper dishwasher basket, in a flexible manner.

An embodiment of the invention is described in connection with the annexed figures, in which FIG. 1 shows a perspective view of a cutlery tray according to the invention attached to a dishwasher basket;

Note that the figures may not be true to scale. It shall further be noted that, for sake of simplicity, the embodiment shown and described in connection with FIGS. 1 to 4 comprises as many claim features as possible. However it is expressly pointed out that the cutlery tray according to the invention must not comprise all the features shown and described in connection with the figures. Rather, some of the features can be omitted or applied as explained in the specification above. Also, alternative and optional features as set out above may be used both alone and in concert with those shown in the figures.

Figure 1:
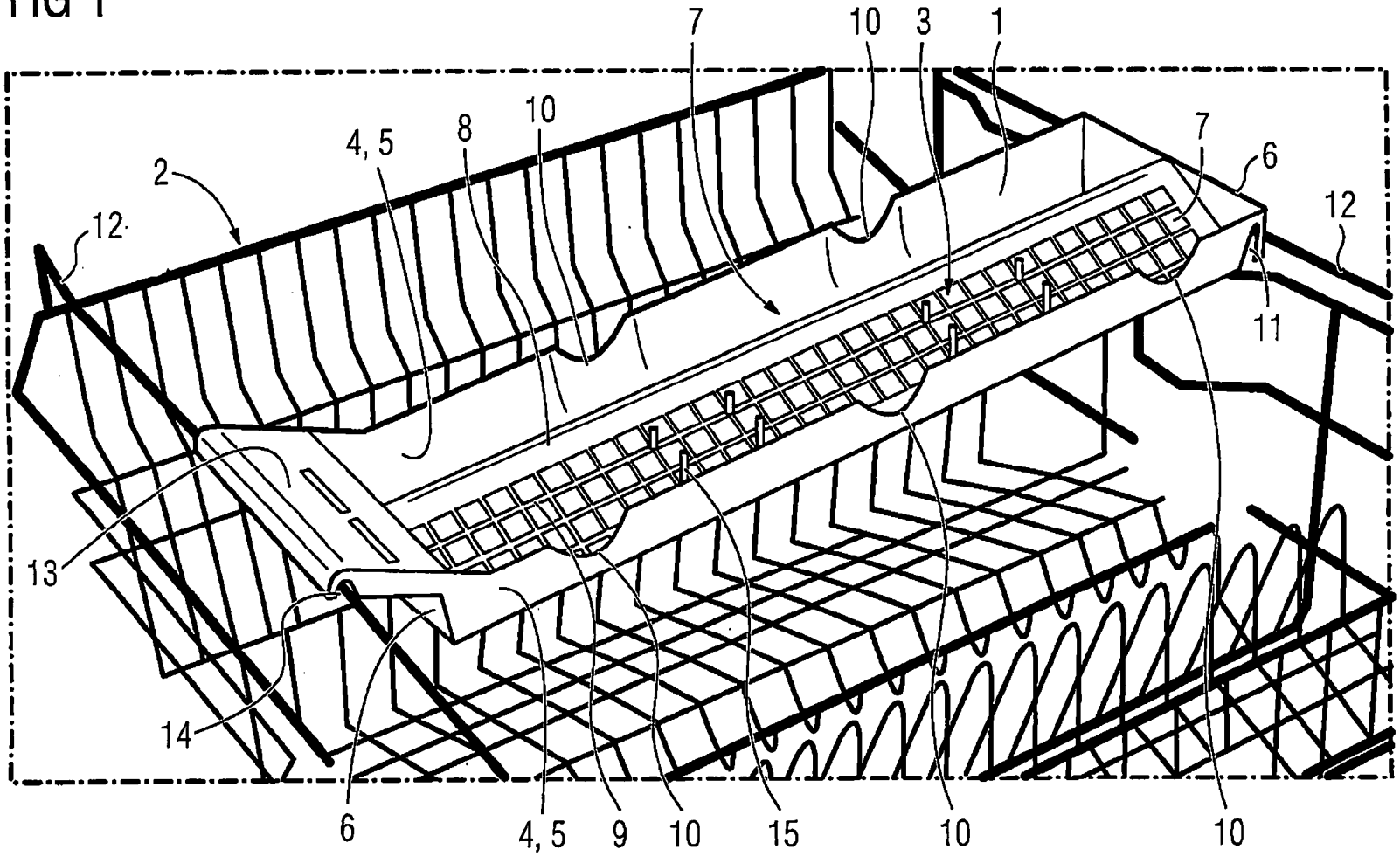

FIG. 1 shows a perspective view of a cutlery tray 1 according to the first aspect of the invention. The cutlery tray 1 is attached to a dishwasher basket 2. Without limiting the scope of the invention, the dishwasher basket 2 is of wire mesh type.

The cutlery tray 1 is designed to receive dishes such as cutlery, for example. However, other kinds of dishes such as drinking vessels, cups or drinking glasses for example, and even other utensils can be placed on the cutlery tray 1. Unless otherwise stated, the term "dish" or "dishes" shall depict any of the aforementioned items.

The cutlery tray 1 comprises a bottom 3, side walls 4, i.e. flanges, at longitudinal margins 5 and face sides 6 connecting the side walls 4. The side walls 4 and face sides 6 inter alia prevent dishes placed on the cutlery tray 1 from falling off the cutlery tray 1. Further they greatly enhance mechanical stability and robustness.

The bottom 3 is divided into two support faces 7 adapted to receive and support dishes placed on the cutlery tray 1.

The support faces 7 connect via a joining portion 8 which is arranged approximately in a mid portion of the cutlery tray 1.

Each of the support faces 7 declines from the joining portion 8 to a respective side wall 4 of the cutlery tray 1. In other words, the upper sides of the support faces 7 enclose an angle of more than 180 degrees. Preferably the support faces decline toward the outside by an angle lying in the range between about 20 degrees to 30 degrees.

Especially if the cutlery tray 1 is positioned in a mid section of the dishwasher basket 2, as depicted in FIG. 1, the lower sides thereof can be oriented towards the center of the dishwasher chamber into which the dishwasher basket 2 will be placed. This provides excellent cleaning efficiency for dishes placed on the cutlery tray 1. In particular, if drinking vessels are positioned in an upside-down orientation on the cutlery tray 1 the inner walls of the vessels can be cleaned efficiently. Reference is made also to the specification above.

Figure 2:
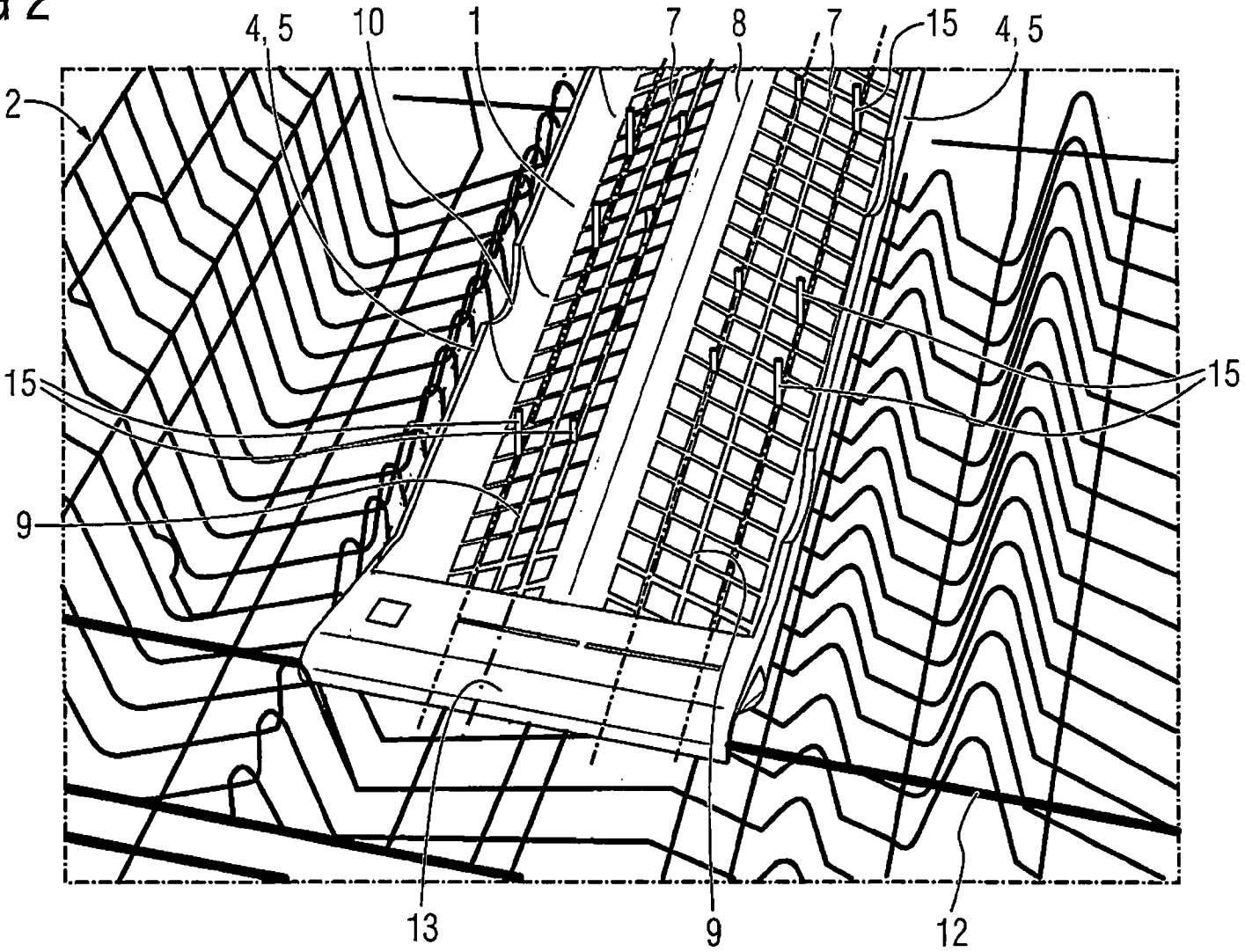
FIG. 2 shows a section of the cutlery tray and dishwasher basket from a different view angle.

As can be seen from FIG. 2, the dimensions of the support faces 7 are symmetric with respect to the joining portion 8. Hence, optimal cleaning efficiency can be achieved on both support faces 7.

The joining portion 8 is shaped as a broadened bar running in lengthwise direction of the cutlery tray 1 and providing mechanical stiffness to the cutlery tray 1.

The support faces 7 are designed as a grid like structure, i.e. a meshwork 9. The meshwork 9 is adapted to allow for efficient cleaning of dishes placed on the cutlery tray 1 while securing sufficient mechanical stiffness. In other words, the aspect ratio of the grid bars is selected such that: i) cleaning liquid can efficiently pass through the meshwork 4, preferably with as less spray shadow as possible, and ii) the meshwork 9 has sufficient load-bearing capacity for receiving all kinds of dishes the cutlery tray is suitable for. Note that for reinforcement reasons the cutlery tray may have grid sections of varying grid robustness. The grid robustness may be selected to respective needs. For example, a middle portion of the support faces may have a more robust grid.

Each of the side walls 4 comprises recesses 10 being arranged offset with respect to the lengthwise direction of the cutlery tray 1. The recesses 10 are oriented away from the support faces 7, i.e. the recesses 10 provided with the side walls 4 open in a direction away from the support faces 7. In the present case, the recesses 10 are of circular shape.

One of the side walls 4 has two recesses 10 while the other one has three recesses 10. Note that the number of recesses 10 can be varied arbitrarily.

If drinking vessels such as cups or drinking glasses or items of similar shape are placed on the cutlery tray 1 they can be positioned such that their opening is oriented towards the support face 7 and a circumferential portion abuts a respective recess 10. In this way the drinking vessels can be prevented from tilting over both in a direction parallel and perpendicular to the joining portion 8. As can be seen, the cutlery tray 1 can be used for various kinds of dishes thereby providing high flexibility with respect to loading a dishwasher. Note that the recesses 10 will not considerably worsen stability and the retaining effect of the side walls 4.

The rear face side 6 at the right hand side in FIG. 1 comprises a rear attachment slot 11 engaging the rear upper wire 12 of the dishwasher basket 2. The frontal attachment arm 13 projecting upwardly from the frontal face side 6 of the cutlery tray shown on the left in FIG. 1 comprises the frontal attachment slot 14 that engages the frontal upper wire 12 of the dishwasher basket 2.

The upper wires 12 and the attachment slots 11 and 14 make up a guideway system allowing the cutlery tray 1 to be moved along the upper wires 12. If a user wants to place a dish, such as a plate for example, into the dishwasher basket 2 he can—if required—move or shift the cutlery tray 1 along the upper wires 12. It is not necessary to completely remove the cutlery tray 1 from the dishwasher basket 2. This is of particular advantage if the cutlery tray 1 is already loaded with dishes. This again shows that the cutlery tray 1 provides high loading flexibility, in particular for loading the dishwasher basket 2 arranged underneath. If required, the cutlery tray 1 can arbitrarily be moved back and forth during loading the dishwasher basket 2 arranged underneath. Further, the working position of the cutlery tray 1 can be selected such that cleaning liquid most efficiently hits the dishes placed on the support faces 7.

Figure 3:
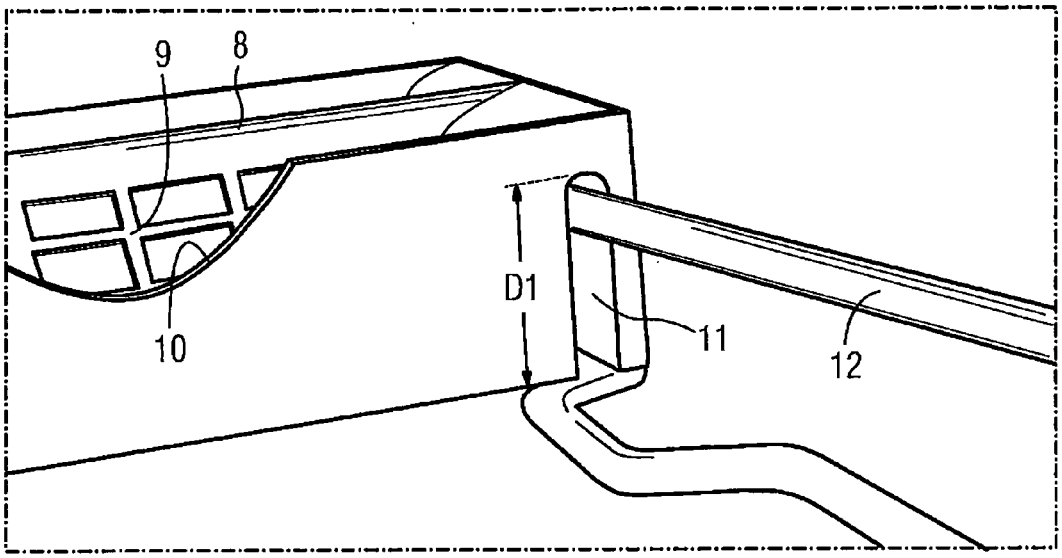
FIG. 3 shows a detail of FIG. 1.
Figure 4:
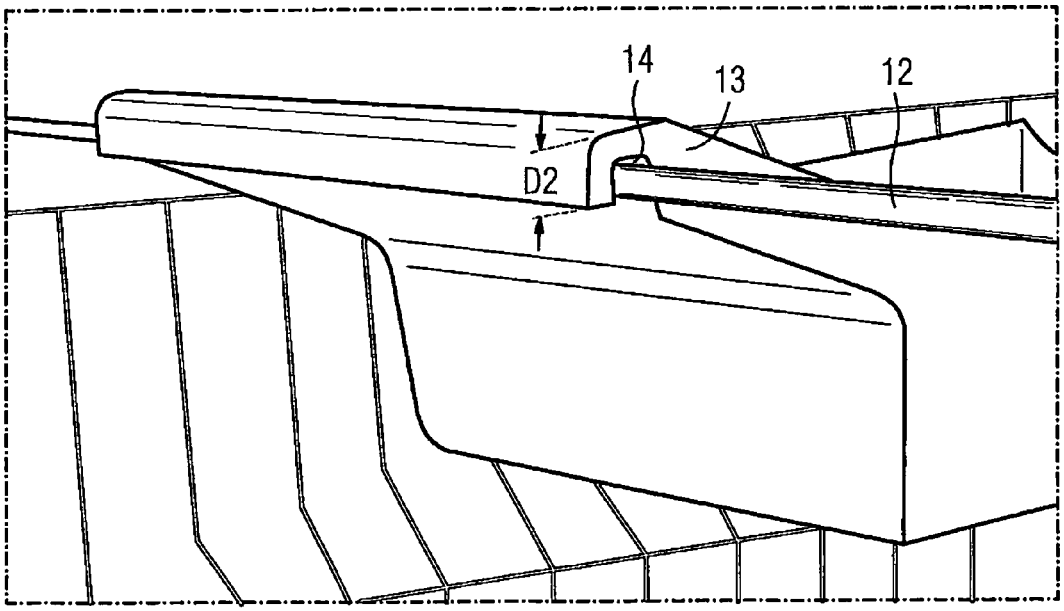
FIG. 4 shows a further detail of FIG. 1.

As can be seen from FIGS. 1, 3 and 4, the depth D1 of the rear attachment slot 11 at the right hand face side 6 in FIG. 1, detailed in FIG. 3, is less than the depth D2 of the frontal attachment slot 14 at the left hand face side in FIG. 1, detailed in FIG. 4. In this way the cutlery tray 1 can be both easily and reliably attached to the dishwasher basket 2. For example, in a first step the rear attachment slot 11 can be engaged with the rear upper wire 12; and in a second step the frontal attachment slot 14 can be engaged with the frontal upper wire 12 in a pivoting movement of the cutlery tray 1.

Note that the opening width of at least one of the attachment slots 11 and 14 can be smaller than the diameter of the respective upper wire 12. This may inter alia be achieved via a small undercut, shown in more detail in FIG. 5. Hence, the cutlery tray 1 can be attached to the dishwasher basket 2 via a snap connection action preventing unintentional removal of the cutlery tray 1 without impairing movability along the upper wires 12.

As can be seen in particular from FIGS. 1 and 2, the dimension of the cutlery tray 1 in a direction perpendicular to the joining portion 8 is less than the respective dimension of the dishwasher basket 2. In other words, the lateral width of the cutlery tray 1 is less than the respective lateral width of the dishwasher basket 2. This allows for high cleaning efficiency and high flexibility with respect to loading the dishwasher basket 2.

Referring again to FIGS. 1 and 2 it can be seen that the support faces 7 comprise bolt-like projections 15, such as spikes for example. The projections 15 are mutually spaced and are oriented vertically with respect to the ordinary operation orientation of the cutlery tray 1 depicted in FIGS. 1 and 2. The projections 15 extend beyond the level of the joining portion 8.

The projections 15 are arranged in several groups. Projections 15 of respective groups are distributed along respective lines running parallel to the joining portion 8, which is indicated by dashed lines in FIG. 2. FIGS. 1 and 2 show that the recesses 10 and projections 15 of a respective support face 7 are offset in a direction parallel to the joining portion 8. Further, recesses 10 and projections 15 provided with one of the support faces 7 are displaced from recesses 10 and projections provided with the other one of the support faces 7.

The projections 15 prevent dishes such as cutlery and other elongate items from sliding downwards the support faces 7 and accumulating in the lower level portion of the cutlery tray 1. The latter would worsen cleaning efficiency.

Figure 5:
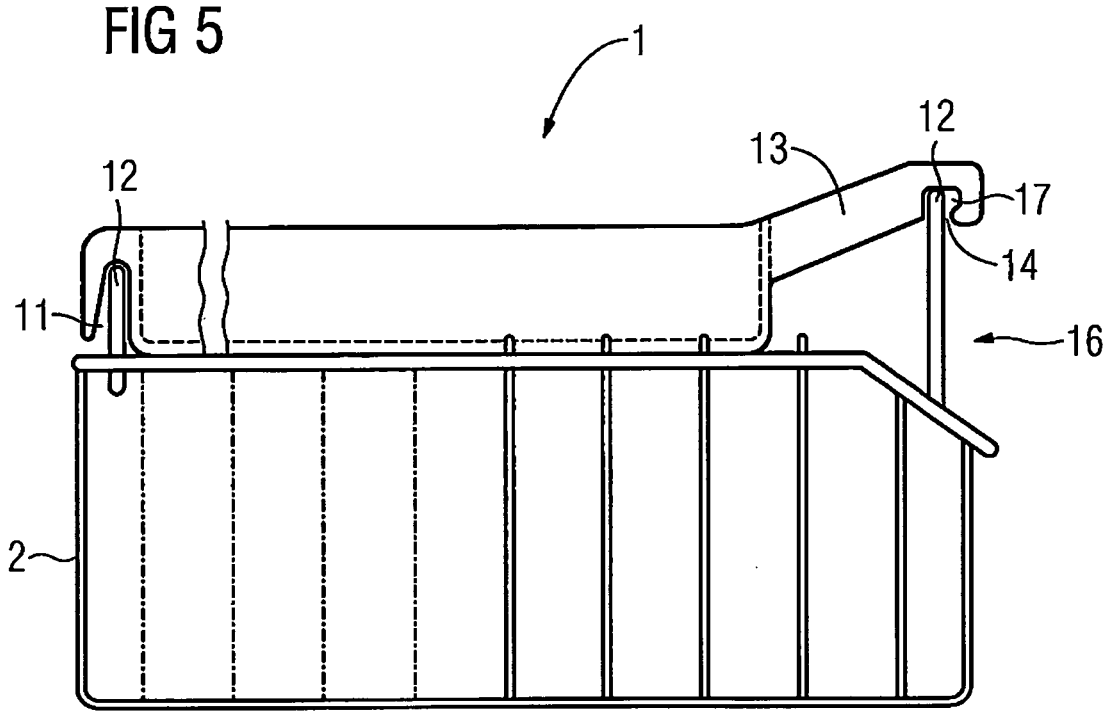
FIG. 5 shows a schematic side view of a dishwasher basket with a cutlery tray attached thereto.

FIG. 5 shows a schematic side view of the dishwasher basket 2 with the cutlery tray 1 being arranged thereon. Here it can be seen that the dishwasher basket 2 is of wire mesh type, and that the cutlery tray 1 being moveably arranged on upper wires 12 of the dishwasher basket 2.

The right-hand side upper wire 12 of the dishwasher basket 2 is somewhat higher, i.e. located at a higher level with respect to the horizontal, than the upper wire 12 at the left-hand side. This is due to the fact that at the right-hand side of the dishwasher basket 2 there is provided a handle-like structure 16 allowing a user to grasp the dishwasher basket 2.

The design of the cutlery tray 1 is adapted to the respective design of the dishwasher basket 2. In detail, the attachment arm 13 located at the right-hand side in FIG. 5 is heading upwards accounting for the raised level of the right-hand wire 12. Thereby, the raised attachment arm 13 provides enough space in a region near the handle-like structure 16 for a user to grasp or move the dishwasher basket 2 via the handle-like structure 16.

A further optional detail shown in FIG. 5 is that the frontal attachment slot 14 may comprise an undercut 17. With the present embodiment, the undercut 17 can prevent unintentional removal of the cutlery tray 1 from the dishwasher basket 2. Note that the rear attachment slot 11 shown in FIG. 5 on the left-hand side does not comprise such an undercut. However, in alternative or in addition also the rear attachment slot 11 may comprise an undercut.

The cutlery tray 1 is designed to be attached movably to the dishwasher basket 2 where the upper end of two opposite side meshes or respectively fully accessible upper wires 12 attached to the side meshes act as rails supporting the cutlery tray 1 and allowing the movement thereon. The footprint of the cutlery tray 1 is a rectangular shape with a small width compared to the width of the holding basket allowing to move the tray from one side to the other to improve the loadability of the dishwasher basket 1 below and to place the tray in working position where the holding dishwasher basket 2 is not loaded heavily to allow sufficient water coming from a not shown spray arm to pass through. The cutlery tray 1 is equipped with guiding or attachment slots 11 and 14 which comprise an opening on the lower side. The guiding or attachment slots 11 and 14 can be either mounted directly at the attachment arms 13 of the tray 1 or at not shown legs attached thereon interacting with upper ends or fixed extra wires 12 of the side meshes of the dishwasher basket 2 to permit the sliding of the tray 1 accordingly.

The attachment slots 11, 14 in the embodiments according to the figures are designed with a small undercut to prevent that the cutlery tray 1 is removed from the holding basket unintentionally. It has shown to be advantageous that the frontal attachment slot 14 is formed in a kind of a leg that is heading upwards so that the front supporting or upper wire 12 is located at a higher level than the rear supporting or upper wire 12 in order to give enough space for a hand that wants to grip the tray 1 or the basket 2, as shown in FIG. 5.

The bottom 3 of the cutlery tray 1 is divided into two support faces 7 which are inclined downwards from the middle joining portion 8 creating a kind of W-shape. The inclination is designed in a way that the opening of cups and pots, placed on a support face upside-down oriented, are heading towards the center of the dishwasher what enhances the cleaning efficiency. Additionally by the inclination of preferably 20 to 30 degrees, the drying performance is improved as no or at least little water remains in the concave bottoms of the cups and pots.

The two inclined bottom support faces 7 additionally comprise groups of projections 15 in the form of star shaped prisms heading vertically in order to hold cutlery as e.g. long knives in a stabile position without creating big contact points to improve the drying result.

The two inclined bottom support faces 7 are extending from the middle joining portion 8 to the left and right boundary or side walls 4 of said cutlery tray. These boundaries 4 are designed as walls or grids and are at least as high as the joining portion 8 in the middle and have the function of reinforcement of the tray 1 but also as a support for e.g. glasses to prevent them to fall off the tray when a laterally acceleration is applied.

The side walls 4 are equipped with small recesses or cut-outs 10 that are especially adapted to cups or glasses and prevent them to move along the tray 1 when the tray-holding basket 2 is moved in or out the dishwasher.

Therefore, a cutlery tray 1 is provided that is allowing high flexibility in loading dishes in a dishwasher with a good cleaning and drying performance also of cups without using an additional rack that is movably attached directly to the cleaning compartment and avoiding the disadvantage of known cutlery rack that shows a flat bottom grid allowing only cutlery to be cleaned in a satisfying way.

Furthermore, additional loading of cups and pots in a stabile and inclined position that allows good cleaning and drying is possible.

The cut-outs or recesses 10 prevent not shown cups from moving along the tray 1.

The opportunity of sideways movements of the cutlery tray 1 improves the loadability of the holding dishwasher basket 2 below and allows bringing it in an advantageous working position.

By designing the frontal attachment slot 14 in a leg or frontal attachment arm 13 that is heading upwards it is achieved enough space between the leg/slot and the receiving frontal support wire 12 or a not shown handle attached to the basket 1 for a hand that wants to grip the cutlery tray 1.

In all, it can be seen that the object of the invention is achieved by the cutlery tray, and therefore the dishwasher basket and dishwasher, according to the invention.

LIST OF REFERENCE NUMERALS

1 cutlery tray
2 dishwasher basket
3 bottom
4 side wall
5 margin
6 face side
7 support face
8 joining portion
9 meshwork
10 recess
11 rear attachment slot
12 upper wire
13 attachment arm
14 frontal attachment slot
15 projection
16 handle-like structure
17 undercut
D1, D2 depth

The invention claimed is:

1. Cutlery tray adapted to be attached to a dishwasher basket and designed to receive dishes thereon, the bottom of which being divided into two support faces for holding cutlery, each of which declines laterally from their joining portion to a respective margin of the cutlery tray;

wherein face sides thereof comprise attachment slots for attaching the cutlery tray to the dishwasher basket, wherein the attachment slots comprise a frontal attachment slot and a rear attachment slot at the respective face sides of the cutlery tray, and wherein the attachment slots are adapted for releasable attachment of the cutlery tray to respective upper rims of the front and the back wall of the dishwasher basket;

wherein the frontal attachment slot is arranged on a frontal attachment arm that extends from a frontal face side of the cutlery tray, the support faces at least partially having a grid structure comprising grid bars, and wherein the joining portion comprises a broadened bar extending longitudinally along and between the two support faces, such that the broadened bar defines a transverse width, perpendicular to a longitudinal dimension of the broadened bar, that is greater than a width of each bar of the grid bars.

2. Cutlery tray according to claim 1, the width thereof being smaller than the corresponding width of the dishwasher basket.

3. Cutlery tray according to claim 1, wherein the length of the cutlery tray in a longitudinal direction spans the front to rear dimension of the dishwasher basket.

4. Cutlery tray according to claim 1, adapted for slidable arrangement on top of the corresponding dishwasher basket on an upper rim thereof.

5. Cutlery tray according to claim 1, the support faces being symmetric with respect to the joining portion.

6. Cutlery tray according to claim 1, wherein the cutlery tray is, in a cross section, W-shaped, wherein the W-shape is formed by the arrangement of side walls with respect to the support faces.

7. Cutlery tray according to claim 1, further comprising flanges arranged at the respective margins, each comprising recesses oriented away from the support faces, the recesses being of circular or oval shape.

8. Cutlery tray according to claim 1, the support faces comprising mutually spaced bolt-shaped projections oriented vertically with respect to the ordinary operation orientation of the cutlery tray, each projection extending at least up to, and beyond the level of the joining portion.

9. Cutlery tray according to claim 8, the projections being arranged in several groups, the projections of each group being distributed along a line running parallel to the joining portion.

10. Cutlery tray according to claim 1, wherein the frontal attachment slot is arranged on the frontal attachment arm that extends upwards sufficiently to provide a free space for allowing ready access to a handle arranged below the frontal attachment arm on the frontal wall of the dishwasher basket.

11. Cutlery tray according to claim 1, the depth (D2) of the frontal attachment slot provided with the frontal attachment arm being less than the depth (D1) of the rear attachment slot provided immediately at the rear face side of the cutlery tray.

12. Dishwasher basket comprising a cutlery tray according to claim 1.

13. Dishwasher comprising at least one of a cutlery tray according to claim 1.

14. Dishwasher comprising a dishwasher basket according to claim 12.

15. A cutlery tray adapted to be attached to a dishwasher basket and designed to receive dishes thereon, the bottom of which being divided into two support faces for holding cutlery, each of which declines laterally from their joining portion to a respective margin of the cutlery tray;

wherein the support faces comprise mutually spaced bolt-shaped projections oriented vertically with respect to the ordinary operation orientation of the cutlery tray, wherein each projection extends at least up to and beyond the level of the joining portion, the support faces at least partially having a grid structure comprising grid bars, and wherein the joining portion comprises a broadened bar extending longitudinally along and between the two support faces, such that the broadened bar defines a transverse width, perpendicular to a longitudinal dimension of the broadened bar, that is greater than a width of each bar of the grid bars.

16. The cutlery tray according to claim 15, the projections being arranged in several groups, the projections of each group being distributed along a line running parallel to the joining portion.

17. The cutlery tray according to claim 15, wherein the projections are configured to maintain two or more cutleries apart from each other and prevent the cutleries from sliding down the support faces.

* * * * *